US007461831B2

(12) United States Patent
Mosley

(10) Patent No.: US 7,461,831 B2
(45) Date of Patent: Dec. 9, 2008

(54) TELESCOPING WORKOVER RIG

(76) Inventor: Robert E. Mosley, 367 Elmo Burton Loop, Minden, LA (US) 71055

( * ) Notice: Subject to any disclaimer, the term of this patent is extended or adjusted under 35 U.S.C. 154(b) by 0 days.

(21) Appl. No.: 11/801,634

(22) Filed: May 10, 2007

(65) Prior Publication Data

US 2007/0272907 A1 Nov. 29, 2007

Related U.S. Application Data

(60) Provisional application No. 60/800,170, filed on May 15, 2006.

(51) Int. Cl.
*B66D 1/14* (2006.01)

(52) U.S. Cl. ..... 254/277; 254/361; 254/388; 254/393; 254/394; 254/397

(58) Field of Classification Search ..... 254/277, 254/284, 285, 336, 338, 361, 388, 393, 394, 254/395, 397

See application file for complete search history.

(56) References Cited

U.S. PATENT DOCUMENTS

| | | | | | |
|---|---|---|---|---|---|
| 3,343,810 | A | | 9/1967 | Parnell | 254/172 |
| 3,714,995 | A | | 2/1973 | Hanes et al. | 175/5 |
| 3,804,183 | A | | 4/1974 | Duncan et al. | 175/5 |
| 3,916,684 | A | * | 11/1975 | Rundell | 73/152.45 |
| 3,936,034 | A | | 2/1976 | Larrald | 254/188 |
| RE29,564 | E | | 3/1978 | Larrald et al. | 254/172 |
| 4,155,538 | A | | 5/1979 | Claassen | 254/172 |
| 4,272,059 | A | | 6/1981 | Noerager et al. | 254/392 |
| 4,290,495 | A | * | 9/1981 | Elliston | 175/85 |
| 4,620,692 | A | | 11/1986 | Foreman et al. | 254/277 |
| 4,688,764 | A | * | 8/1987 | Nayler et al. | 254/277 |
| 4,796,863 | A | * | 1/1989 | Reed | 254/337 |
| 4,867,418 | A | * | 9/1989 | Daniels | 254/277 |
| 5,351,430 | A | | 10/1994 | Hystad | 43/9.1 |
| 5,894,895 | A | * | 4/1999 | Welsh | 175/5 |
| 6,343,662 | B2 | * | 2/2002 | Byrt et al. | 173/4 |
| 6,595,494 | B1 | | 7/2003 | Roodenburg et al. | 254/277 |

(Continued)

*Primary Examiner*—Emmanuel M Marcelo
(74) *Attorney, Agent, or Firm*—John M. Harrison

(57) ABSTRACT

A telescoping workover rig is characterized by a derrick having a bottom mast section mounted on a base or carrier and a top mast section telescopically fitted in the bottom mast section. In functional configuration a system of tram sheaves mounted on movable trams and connected to opposite fixed stationary sheaves by a continuous cable, serve to raise and lower a travelling block suspended by the cable from travelling block sheaves and crown sheaves in the extended top mast section. The trams that mount the tram sheaves are fitted to the ends of one or a pair of cylinder rods extending from a corresponding tram drive cylinder or cylinders. This arrangement facilitates hydraulic extension and retraction of the cylinder rod or rods, corresponding movement of the trams and tram sheaves and extending and shortening of the loops of the cable wound on the tram sheaves and stationary sheaves, as well as the crown sheaves and travelling block sheaves, to control raising and lowering of the traveling block suspended in the derrick. A lifting cylinder or cylinders are mounted on the carrier and each lifting cylinder has a cylinder rod connected to the derrick for raising and lowering the derrick. A scoping cylinder is provided on the bottom mast section and uses a scoping cylinder cable connected to the top mast section to raise and lower the top mast section telescopically with respect to the bottom mast section.

35 Claims, 13 Drawing Sheets

U.S. PATENT DOCUMENTS 6,662,110 B1 * 12/2003 Bargach et al. ..... 702/6
6,926,260 B1 8/2005 DeGroot et al. ..... 254/277
7,152,672 B1 * 12/2006 Gipson ..... 166/77.2
7,165,759 B2 * 1/2007 Welsh ..... 254/399

* cited by examiner 7
7b
7a
7a
8
8
7
7
4
33
63
59
5
1
3
56
64
58
2
16
7
7a
9
6
8
10
8
7b
46
45
54
5
52
59
33
8
33
47
48
15
57
57a
18
33
8
8
17
56
49
49
8
21
21
58
50
61
50
16
55
8
60
8
31
31
54
46
27

44
45
52
33
53
49
62
37
42
50
36
9
51
29
33
20
61
21
37
60
36
27
38
43
35
8
8
31
43a

TELESCOPING WORKOVER RIG

CROSS-REFERENCE TO RELATED APPLICATIONS

This application claims the benefit of and incorporates by reference in its entirety U.S. Provisional Application Ser. No. 60/800,170, filed May 15, 2006.

SUMMARY OF THE INVENTION

This invention relates to workover rigs and more particularly, to a telescoping workover rig having a derrick which is characterized by a bottom mast section fitted with a telescoping top mast section. Telescoping of the top mast section upwardly and downwardly in the bottom mast section is typically effected by a scoping cylinder attached to the bottom mast section and a corresponding scoping cylinder cable extending around a system of sheaves on the scoping cylinder rod and the bottom mast section and extending to the top mast section. A travelling block is suspended by traveling block sheaves from crown sheaves mounted on a water table at the top of the top mast section, using a single, continuous operating cable, one dead end of which is typically attached to one side of a base or carrier supporting the bottom mast section or to the bottom mast section itself and the other dead end fitted to the opposite side of the base or carrier or to the bottom mast section. The operating cable is wound from the first fixed dead end around a system of tram sheaves rotatably mounted on a first movable tram and around facing stationary sheaves mounted on an aligned first stationary sheave mount typically fixed to a hydraulic drive cylinder. The operating cable then extends from the first set of stationary sheaves directly upwardly, or from the first set of tram sheaves and around a fast line sheave and then upwardly, around a first crown sheave at the water table and downwardly to a travelling block sheave. From there the operating cable is wound around a dead man crown sheave also at the water table, back down to a second traveling block sheave and again upwardly, to a second crown sheave at the water table. Finally, the operating cable is directed downwardly, either directly to a second set of stationary sheaves, or around a second fast line sheave to the second set of aligned tram sheaves and stationary sheaves, to the second fixed dead end. The trams are hydraulically operated with respect to the fixed stationary sheave mounts carrying the stationary sheaves, by one or more tram drive cylinders to lengthen and shorten the loops of operating cable extending between the tram sheave banks on the parallel trams and the opposing fixed stationary sheaves, respectively, and selectively raise and lower the traveling block when the top mast section is fully upwardly extended in the bottom mast section. This extended configuration of the top mast section is secured by a top mast support assembly, typically using a pair of hydraulically extendible and retractable pins. The carrier can be characterized by a transporter for self-contained transportation or the workover rig may be mounted on a conventional flatbed trailer or other truck or vehicle and transported to a well site, as desired. The rig may also be secured on a fixed base such as a concrete slab, as desired. A lifting cylinder or cylinders is typically mounted on the transporter, truck or vehicle and has a cylinder rod extending to a pivotally-mounted derrick for raising and lowering the derrick into operating and transportation configuration, respectively.

BRIEF DESCRIPTION OF THE DRAWINGS

The invention will be better understood by reference to the accompanying drawings, wherein.

DESCRIPTION OF THE PREFERRED EMBODIMENTS

Figure 1:
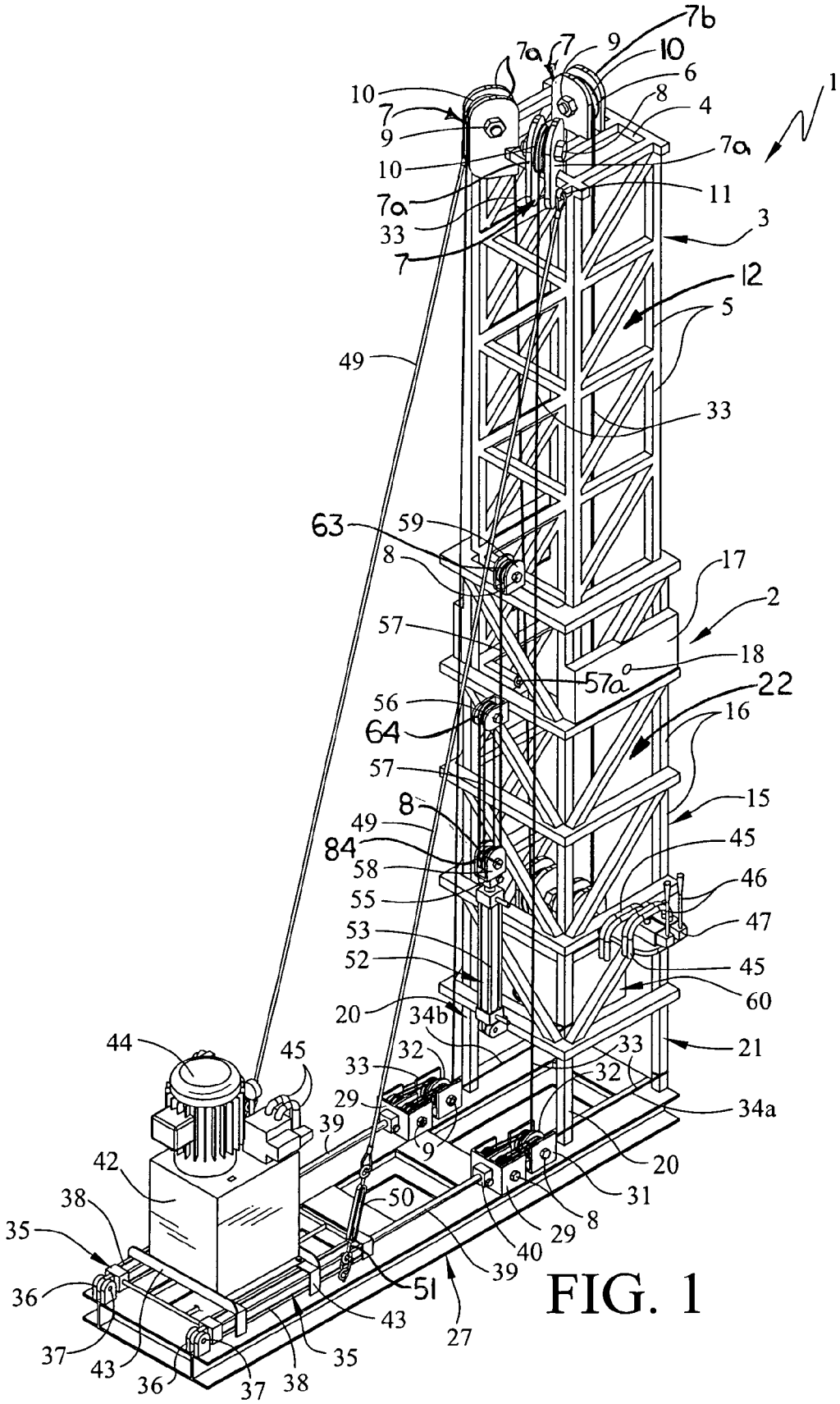
FIG. 1 is a front perspective view of an illustrative embodiment of the telescoping workover rig, with a top mast section extended in functional configuration from a bottom mast section of the workover rig.

Referring initially to FIGS. 1-8 of the drawings, in some illustrative embodiments the telescoping workover rig is generally illustrated by reference numeral 1 and include a derrick 2 having a top mast section 3 and a bottom mast section 15. A top mast opening 12 extends through the top mast section 3, and a bottom mast opening 22 extends through the bottom mast section 15. Accordingly, the top mast section 3 is telescopically mounted inside and extendable from the bottom mast section 15 typically in a manner which will be hereinafter described. The top mast section 3 is constructed of various top mast members 5, while the bottom mast section 15 may be built of similar or dissimilar bottom mast members 16.

Figure 3:
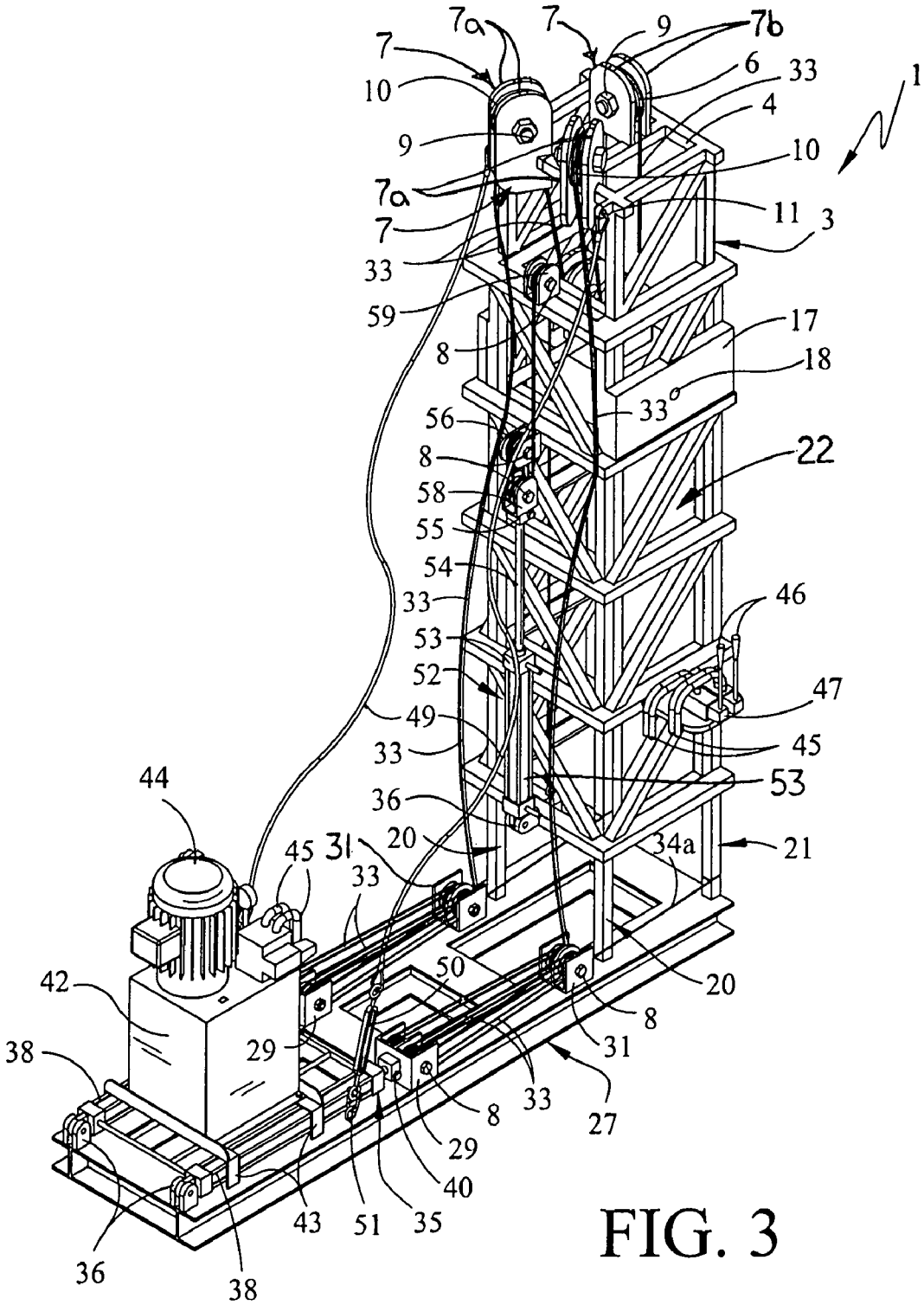
FIG. 3 is a front perspective view of an illustrative embodiment of the workover rig, with the top mast section downwardly telescoped partially inside the bottom mast section.
Figures 4, 5:
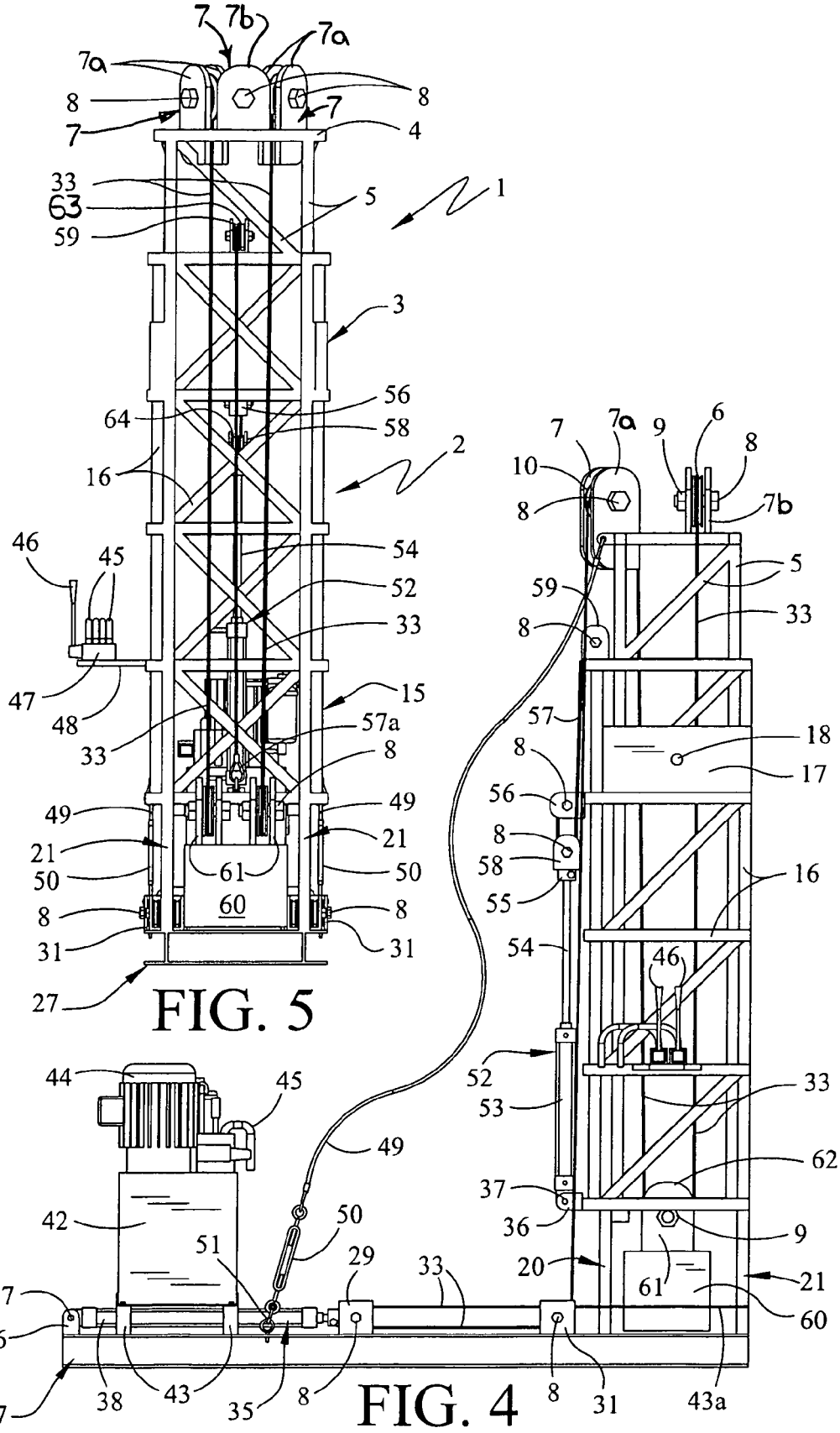
FIG. 4 is a side elevation of an illustrative embodiment of the telescoping workover rig.
FIG. 5 is a rear elevation of an illustrative embodiment of the telescoping workover rig.
Figure 7:
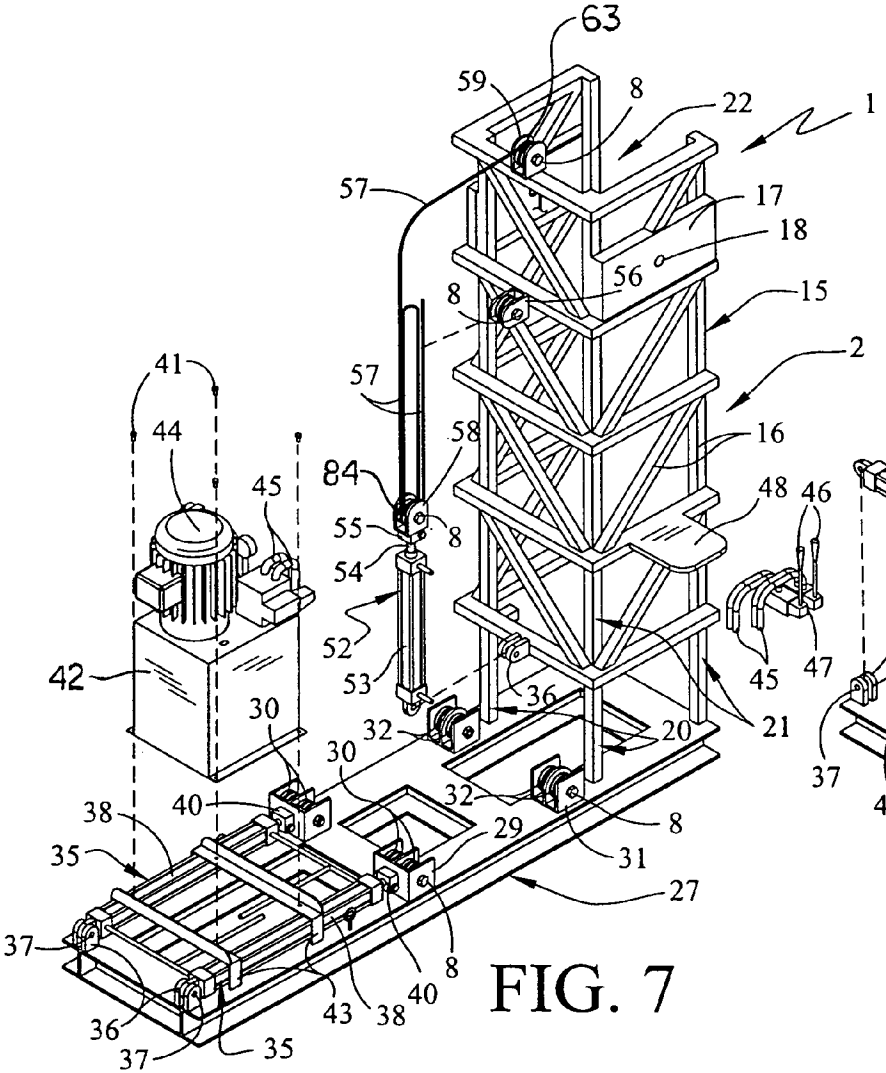
FIG. 7 is an exploded front perspective view of the bottom mast section of an illustrative embodiment of the telescoping workover rig, including a scoping cylinder assembly for extending and retracting the top mast section with respect to the bottom mast section.

The telescoping function of the top mast section 3 with respect to the bottom mast section 15 may be accomplished utilizing a scoping cylinder assembly 52, for example. The scoping cylinder assembly 52 includes a scoping cylinder 53, affixed to the bottom mast section 15 at a cylinder mount bracket 36 and mount bracket pin 37, as illustrated in FIGS. 3, 4 and 7. Referring to FIG. 4, the scoping cylinder 53 element of the scoping cylinder assembly 52 includes a scoping cylinder rod 54, which is selectively extendable and retractable with respect to the scoping cylinder 53. A scoping cylinder rod bracket 58 is attached to the extending or distal end of the scope cylinder rod 54 typically by a scoping cylinder rod mount 55. As it is extended from the scoping cylinder 53, the scoping cylinder rod 54 raises the scoping cylinder rod bracket 58 toward a scoping cylinder sheave bracket 56 which is fixed to the top section of the bottom mast section 15; as it is retracted into the scoping cylinder 53, the scoping cylinder rod 54 lowers the scoping cylinder rod bracket 58 away from the scoping cylinder sheave bracket 56.

Figure 12:
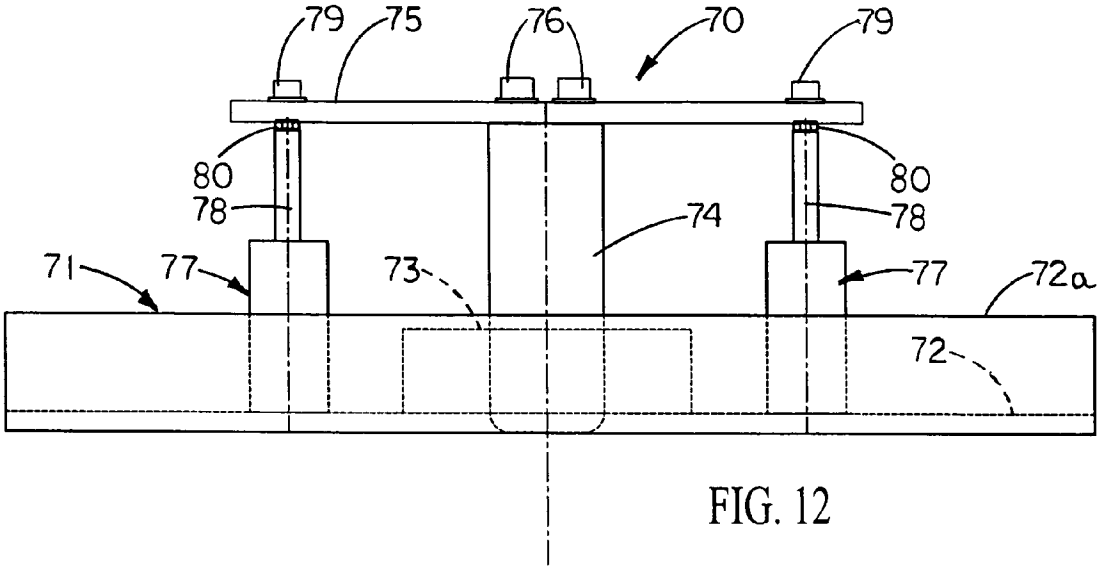
FIG. 12 is a plan view of an exemplary top mast support assembly in mast-release configuration for supporting the top mast in elevated configuration in the bottom mast of the derrick.

As illustrated in FIGS. 1, 4 and 7, a scoping cylinder cable 57 is wound on a first pair of sheaves 84 which is rotatably attached to the scoping cylinder rod bracket 58 by a sheave mount bolt 8 and a second pair of sheaves 64 which is rotatably mounted on the scoping cylinder sheave bracket 56 by another sheave mount bolt 8. The scoping cable 57 is also wound on a third sheave 63, rotatably mounted on a lifting sheave bracket 59 typically by a sheave mount bolt 8. The lifting sheave bracket 59 is bolted or otherwise fixed to the top section of the bottom mast section 15, as further illustrated in FIG. 1. The scoping cylinder cable 57 extends downwardly from the third sheave 63 and is secured to the bottom portion of the top mast section 3 at a cable mount 57*a*. Accordingly, extension of the scoping cylinder rod 54 from the scoping cylinder 53 by hydraulic operation of the scoping cylinder 53 causes the loops of scoping cylinder cable 57 to shorten between the scoping sheave bracket 56 and the scoping cylinder rod bracket 58 and thus lower or retract the top mast section 3 telescopically inside the bottom mast section 15, as illustrated in FIGS. 3, 4 and 5 of the drawings. Corresponding retraction of the scoping cylinder rod 54 in the scoping cylinder 53 lengthens the loops of scoping cylinder cable 57 extending between the scoping cylinder sheave bracket 56 and scoping cylinder rod bracket 58 and forces the top mast section 3 upwardly from inside the bottom mast section 15, to the position illustrated in FIGS. 1 and 2 of the drawings. Securing of the top mast section 3 on the bottom mast section 15 in this extended position may be accomplished by activating a top mast support assembly mechanism 70 illustrated in FIGS. 9 and 12, mounted in the bottom mast section 15 and having a pair of movable support pins 74, for removably engaging corresponding mount plate openings provided in a pair of spaced-apart support channels 71, respectively, mounted on the bottom mast section 15, as will be hereinafter further described.

Figure 2:
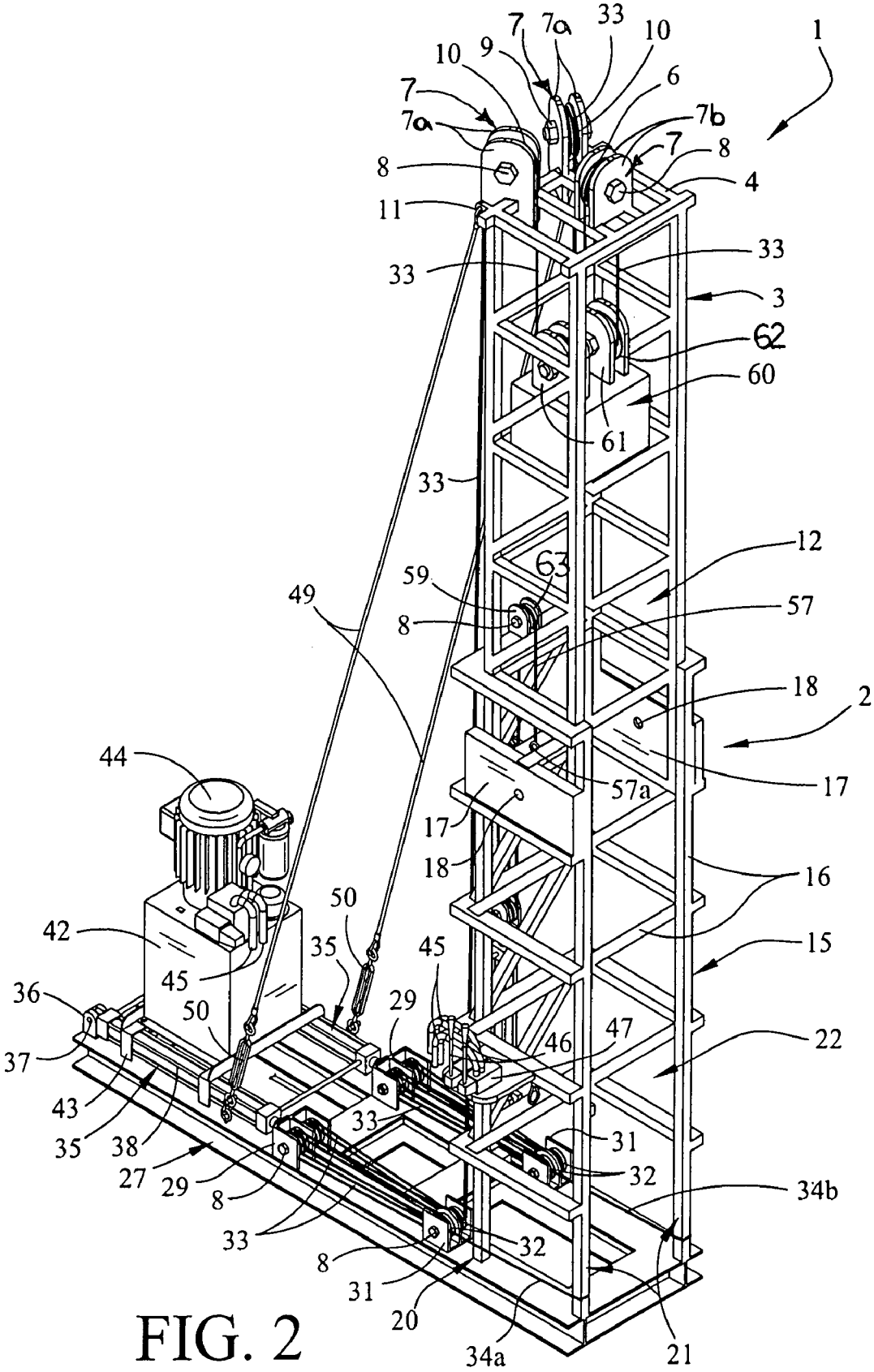
FIG. 2 is a rear perspective view of an illustrative embodiment of the telescoping workover rig.

As further illustrated in FIGS. 1 and 2 of the drawings, the bottom of the bottom mast section 15 is provided with front mast legs 20 and rear mast legs 21, the former of which are typically either pivotally or fixedly attached to a base or carrier 27. In some embodiments, the front mast legs 20 are pivotally attached to the carrier 27, with the rear mast legs 21 removably fitted and typically pinned to the carrier 27 in any convenient fashion, such that the entire telescoped derrick 2 of the telescoping workover rig 1 can be pivoted over the carrier 27 into a suitable telescoped configuration for transportation purposes, as hereinafter described. Alternatively, both the front mast legs 20 and the rear mast legs 21 may be welded or otherwise fixed to a fixed base (not illustrated) or the carrier 27 as illustrated in FIGS. 1 and 2 of the drawings, such that the derrick 2 typically has a rearward lean or tilt of about 3 degrees from the vertical.

Figure 8:
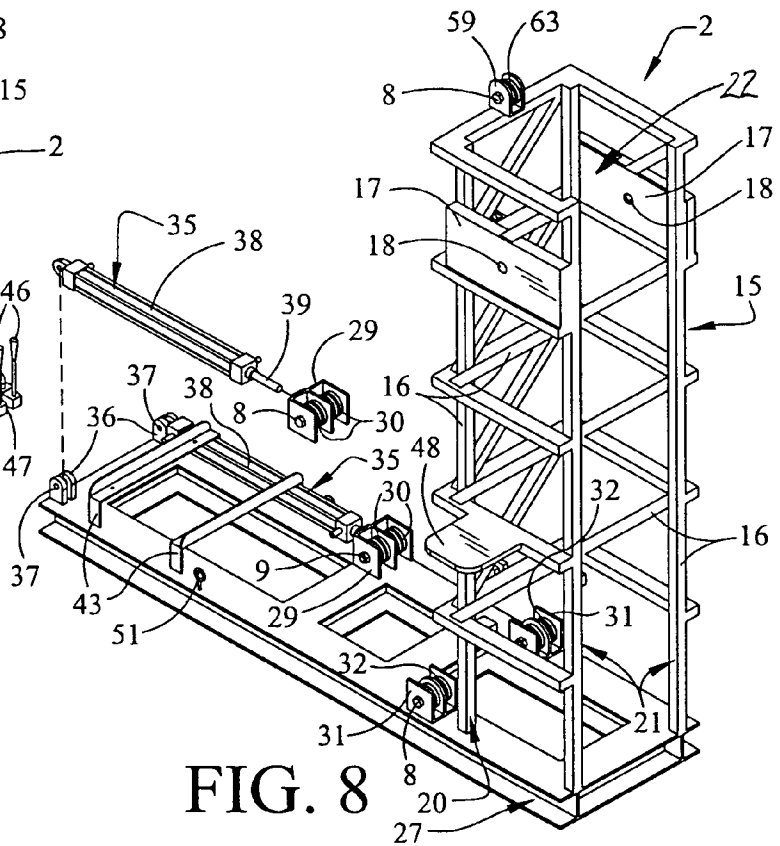
FIG. 8 is an exploded rear perspective view of an illustrative embodiment of the telescoping workover rig, more particularly illustrating a parallel drive cylinder assembly.

As illustrated in FIGS. 1-8, in some embodiments, a pair of spaced-apart stationary sheave mounts 31 is located forwardly of the front mast legs 20 of the derrick 2. The stationary sheave mounts 31 are welded, bolted or otherwise fixed to the carrier 27. As illustrated in FIGS. 1, 7 and 8, at least one and more preferably, multiple (typically three) stationary mount sheaves 32 are rotatably mounted on a common sheave mount axle or bolt 8 in each stationary sheave mount 31. The mount axle or bolt 8 is typically secured by a nut 9. A pair of spaced-apart, movable trams 29 is linearly aligned with the stationary sheave mounts 31, respectively. Each of the trams 29 includes at least one, and more preferably, multiple (typically 3) tram sheaves 30 (FIGS. 7 and 8) which are typically rotatably mounted in the tram 29 by means of a common sheave mount bolt 8. The trams 29 are fitted to the ends of a pair of spaced-apart drive cylinder rods 39, respectively, which are telescopically extendable from respective drive cylinders 38, typically by means of drive cylinder rod mounts 40, respectively, as illustrated in FIG. 1 of the drawings. The drive cylinders 38 are secured to the carrier 27 in generally parallel relationship with respect to each other, typically by means of reservoir mount brackets 43. The ends of the drive cylinders 38 which are opposite the respective drive cylinder rods 39 are secured to respective drive cylinder mount brackets 36, welded or bolted to the carrier 27 and fitted with mount bracket pins 37, respectively.

A hydraulic fluid reservoir 42 is seated on the carrier 27, typically between the drive cylinders 38 and is attached thereto by the reservoir mount brackets 43 and reservoir mount bolts 41 (FIG. 7). Hydraulic fluid lines 45 are provided on the hydraulic fluid reservoir 42 and extend to a source of hydraulic fluid (not illustrated) provided in the hydraulic fluid reservoir 42. An electric motor 44 is mounted on the hydraulic fluid reservoir 42 for pumping the hydraulic fluid inside the hydraulic fluid reservoir 42 through the hydraulic fluid lines 45 to hydraulic fluid control valves 47 (FIG. 1), typically mounted on a manifold mount plate 48 on the bottom mast section 15 (FIGS. 7 and 8). Additional hydraulic fluid lines (not illustrated) connect the hydraulic fluid control manifold 47 to the scoping cylinder 53 and to the drive cylinders 38. Hydraulic valve operators 46 are provided on the hydraulic fluid control valves 47 to facilitate selective energizing of the electric motor 44 and control of the flow of hydraulic fluid through the hydraulic fluid lines 45 for pumping of hydraulic fluid to and from the hydraulic fluid reservoir 42 and the scoping cylinder 53 and the twin drive cylinders 38, as hereinafter further described.

Three pairs of crown sheave mounts 7 are welded or otherwise attached to a water table top 4 at the top of the top mast section 3, typically in the configuration illustrated in FIGS. 1 and 2 of the drawings. Two forward pairs 7*a* of the crown sheave mounts 7 each accommodates a fast line crown sheave 10, rotatably mounted to the corresponding forward pair 7*a* of the crown sheave mount 7 such as by a sheave mount bolt 8 and a nut 9, for example. A rear pair 7*b* of the crown sheave mounts 7 is located rearwardly of and typically in angular relationship with respect to the forward pair 7*a* of crown sheave mounts 7 and accommodates a dead man crown sheave 6, which is rotatably secured to the rear pair 7*b* of crown sheave mounts 7 such as by means of another sheave mount bolt 8 and corresponding nut 9, for example.

As illustrated in FIG. 1, an operating cable 33 has a first cable end 34*a* secured to the bottom mast section 15 at a rear mast leg 21 on one end of the carrier 27. From the fixed first cable end 34*a*, the operating cable 33 winds in multiple loops around a first bank of the tram sheaves 30 (FIGS. 7 and 8) which is rotatably mounted in one of the trams 29 and around the aligned stationary mount sheaves 32, which are rotatably mounted in an adjacent or aligned fixed or stationary sheave mount 31. From the stationary mount sheaves 32, the operating cable 33 extends from one of the stationary mount sheaves 32 upwardly around one of the fast line crown sheaves 10, rotatable in a corresponding forward pair 7*a* of crown sheave mounts 7 provided on the water table top 4 of the top mast section 3. From the fast line crown sheave 10, the operating cable 33 extends downwardly into the top mast opening 12 of the top mast section 3 and around a traveling block sheave 62 (FIGS. 2 and 6) which is rotatably mounted on a corresponding one of two traveling block sheave mounts 61, welded or otherwise attached to a traveling block 60. The operating cable 33 extends from the traveling block sheave 62 upwardly around the dead man crown sheave 6 which is rotatable on the rear pair 7*b* of crown sheave mounts 7 fixed to the water table top 4. From the dead man's crown sheave 6, the operating cable 33 extends downwardly into the top mast opening 12 of the top mast section 3 and around a second travelling block sheave 62 which is rotatably mounted on a corresponding second travelling block sheave mount 61 provided on the traveling block 60.

From the traveling block sheave 62, the operating cable 33 extends upwardly to the second fast line crown sheave 10 which is rotatable on the corresponding forward pair 7*a* of the crown sheave mounts 7 and back downwardly to the aligned second set of stationary mount sheaves 32 (FIG. 1) and tram sheaves 30, and to fixed attachment to the adjacent rear mast leg 21 at the second cable end 34*b*. Accordingly, it will be appreciated by those skilled in the art that the operating cable 33 may be a single cable which extends from the bottom mast section 15 at the first cable end 34*a*, around the respective sheaves delineated above and back to fixed attachment to the bottom mast section 15 at the second cable end 34*b*. Therefore, simultaneous extension and retraction of the drive cylinder rods 39 in the respective drive cylinders 38 by operation of the hydraulic fluid operators 46, respectively, shortens and lengthens, respectively, the loops of the operating cable 33 which extend between the respective aligned sets of sheaves 32, 30 in the stationary sheave mounts 31 and trams 29, respectively, to selectively raise and lower the traveling block 60 in the top mast opening 12 and bottom mast opening 22 of the derrick 2 (FIG. 2).

Referring again to FIGS. 1-4 of the drawings, a pair of load lines 49 extends from attachment to the top mast section 3 at respective load line mounts 11, typically secured to the water table top 4, downwardly to a pair of load line turnbuckles 50, which are typically secured to the carrier 27 by a respective pair of turnbuckle bolts 51. Accordingly, when the derrick 2 is in the functional configuration illustrated in FIGS. 1 and 2 with the top mast section 3 extended upwardly to full length with respect to the bottom mast section 15, the load line turnbuckles 50 can be selectively tightened or loosened to adjust the tension in each of the load lines 49 prior to and during the substantially vertical operation of the traveling block 60 via the hoisting action of the operating cable 33.

It will be appreciated by those skilled in the art that the telescoping workover rig 1 of this invention is typically utilized to pull tubing or pipe (not illustrated) from oil and gas wells (not illustrated) using the traveling block 60, which is positioned over the well. The derrick 2 of the telescoping workover rig 1 is initially positioned at about a three degree tilt to within about 5 feet of a well (not illustrated). The traveling block 60 is attached to the well pipe typically in conventional fashion to lift the pipe string (not illustrated) from the well and remove the pipe using conventional techniques. Raising and lowering of the traveling block 60 to achieve this end is effected by lengthening and shortening of the operating cable 33 through operation of the two parallel drive cylinders 38 of the drive cylinder assembly 35, typically by manipulation of the hydraulic fluid operators 46 of the hydraulic fluid control manifold 47, as was heretofore described.

As was heretofore described, under circumstances where the derrick 2 is in the telescoped or collapsed configuration illustrated in FIGS. 3-5 of the drawings, the top mast section 3 can be raised telescopically with respect to the bottom mast section 15 by operating the scoping cylinder 53 in the scoping cylinder assembly 52 using the hydraulic fluid operators 46. Accordingly, manipulation of the appropriate hydraulic fluid operators 46 causes hydraulic fluid to flow from the hydraulic fluid reservoir 42, through the hydraulic fluid lines 45 and to the scoping cylinder 53 to retract the scoping cylinder rod 54 in the scoping cylinder 53 and tighten the single scoping cylinder cable 57. This action causes the scoping cylinder cable 57 to lengthen between the second pair of cylinder sheaves 64 mounted on the scoping cylinder sheave bracket 56 and the first pair of sheaves 84 mounted on the scoping cylinder rod bracket 58 and raise the top mast section 3 from the bottom mast opening 22 of the bottom mast section 15 into the extended position illustrated in FIGS. 1 and 2. Extension of the top mast section 3 from the bottom mast section 15 also tensions the load lines 49. This tensioning of the load lines 49 can be adjusted to compensate for the load to be applied to the derrick 2, as deemed necessary, by adjustment of the respective load line turnbuckles 50. The telescoping workover rig 1 is then ready to be placed in working position adjacent to the well (not illustrated) as described above to facilitate pulling pipe or tubing (not illustrated) from the well.

The traveling block 60 is next lowered into position for engaging the pipe in the well by operating the respective drive cylinders 38 of the drive cylinder assembly 35 to extend the drive cylinder rods 39 from the respective drive cylinders 38, as illustrated in FIG. 1. This extending action of the drive cylinder rods 39 shortens those portions or loops of the operating cable 33 which extend between the tram sheaves 30 (FIG. 7) of the respective trams 29 and the stationary mount sheaves 32 (FIG. 7) of the respective stationary sheave mounts 31. Operation of the drive cylinders 38 in this manner is accomplished typically by manipulation of the appropriate hydraulic fluid operators 46 of the hydraulic fluid control manifold 47, causing hydraulic fluid to flow from the hydraulic fluid reservoir 42, through the hydraulic fluid lines 45 and into the respective drive cylinders 38, to extend the respective drive cylinder rods 39 into the configuration illustrated in FIG. 1. The lowered traveling block 60 can then be attached in conventional fashion to the pipe in the well. When it is desired to lift this pipe from the well, the traveling block 60 is raised by reversing operation of the drive cylinders 38, thus retracting the drive cylinder rods 39 into the respective drive cylinders 38 by corresponding operation of the hydraulic fluid operators 46. The operating cable 33 is thusly lengthened on the respective aligned tram sheaves 30 and stationary mount sheaves 32, as illustrated in FIG. 2 of the drawings. The traveling block 60 is raised to the position illustrated in FIG. 2, after which the extracted pipe can be removed from the traveling block 60 and set aside for another sequence of lowering the traveling block 60 and re-attachment of the traveling block 60 to another length of the pipe in the well.

It will be appreciated by those skilled in the art that the telescoping workover rig 1 of this invention can be designed in any desired size, with a derrick 2 of desired height and a top mast section 3 and bottom mast section 15 of desired dimensions and construction, according to the nature and location of the well to be serviced. Furthermore, the size and type of electric motor 44 can be chosen according to the necessary requirements for pumping hydraulic fluid from a hydraulic fluid reservoir 42 of selected size. The hydraulic fluid operators 46 can likewise be sized and chosen to accommodate the electric motor 44 used in a hydraulic system of desired specification. Moreover, the workover rig 1 may be mounted on a fixed base or slab (not illustrated) or the carrier 27 may be mounted on or defined by a truck or other transporter vehicle for transportation purposes. Alternatively, the carrier 27 may be built into a vehicle design of choice, as desired.

It will be further appreciated by those skilled in the art that, as was heretofore described, the front mast legs 20 of the bottom mast section 15 may be hingedly or pivotally attached to the carrier 27 and the rear mast legs 21 seated on the carrier 27 and pinned or bolted thereto, as desired, to facilitate pivotally lowering the derrick 2 into transportation configuration. In this regard, one or more hydraulic cylinders (not illustrated) may be added to the telescoping workover rig 1 for the purpose of raising and lowering the derrick 2 to and from the transportation and working configurations, respectively, as will be hereinafter described, according to the knowledge of those skilled in the art.

Figure 9:
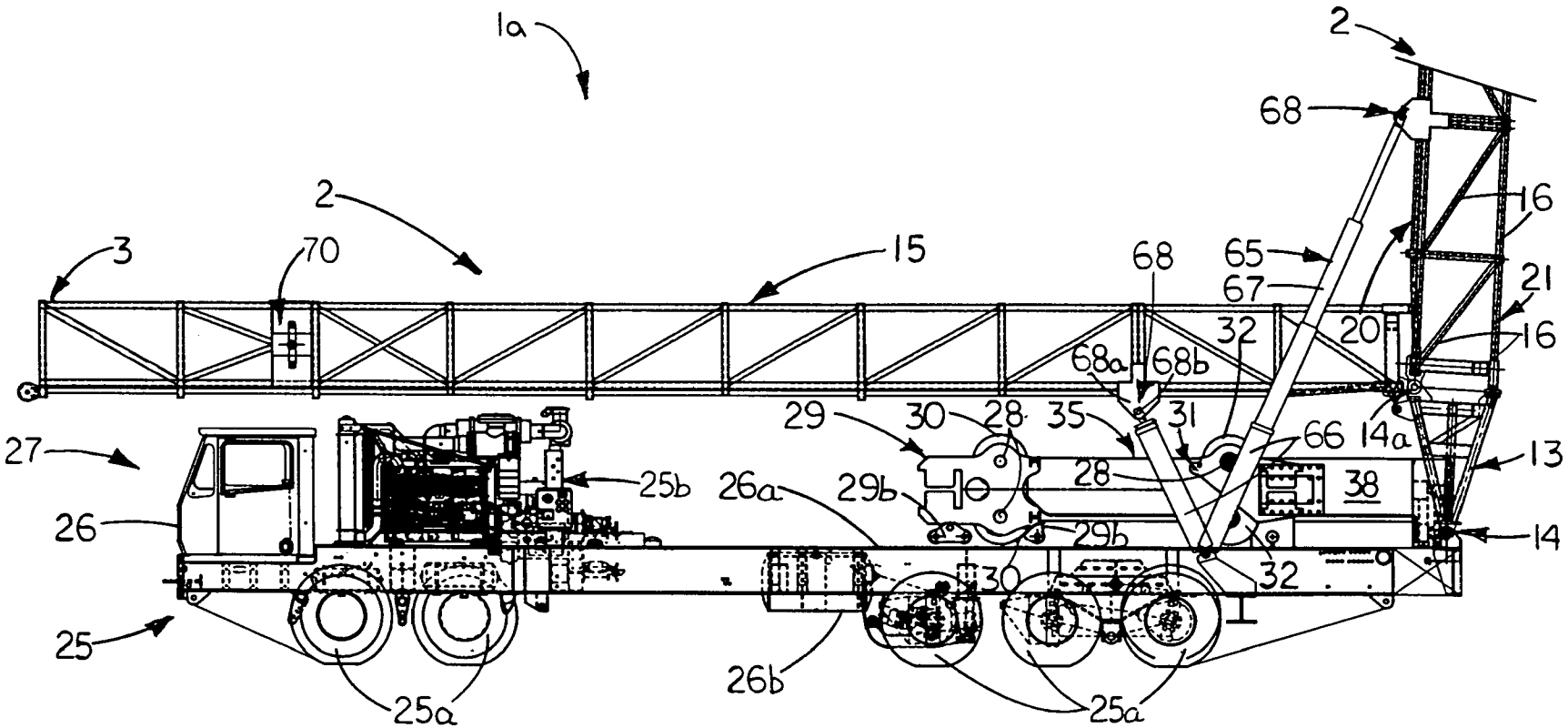
FIG. 9 is an elevational view of an exemplary carrier or transporter with an illustrative single tram drive cylinder embodiment of the telescoping workover rig pivotally mounted thereon.
Figure 9A:
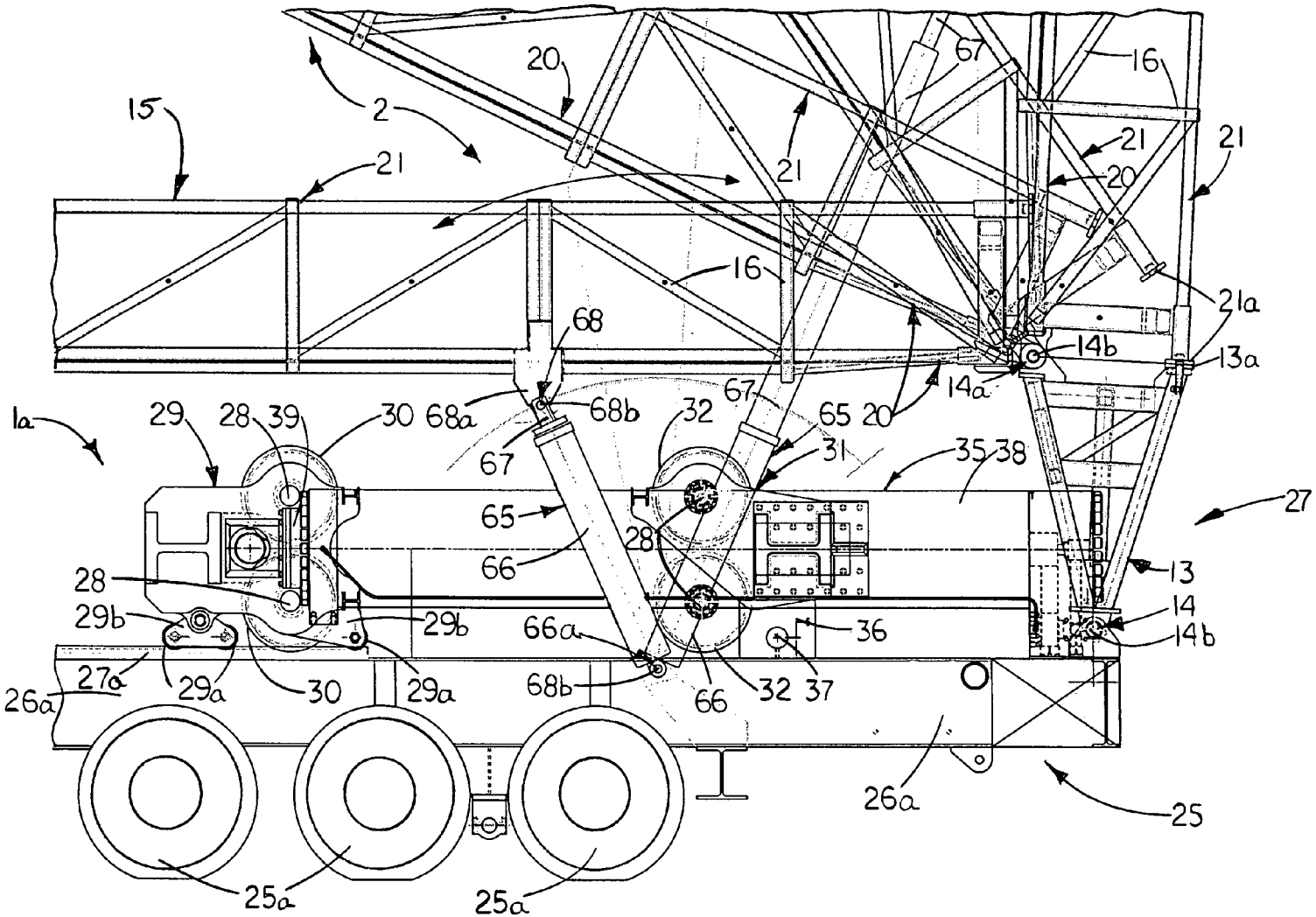
FIG. 9A is an elevational view, partially in section, of a rear segment of an illustrative embodiment of the transporter and the telescoping workover rig, more particularly illustrating a typical derrick pivoting function.
Figure 16:
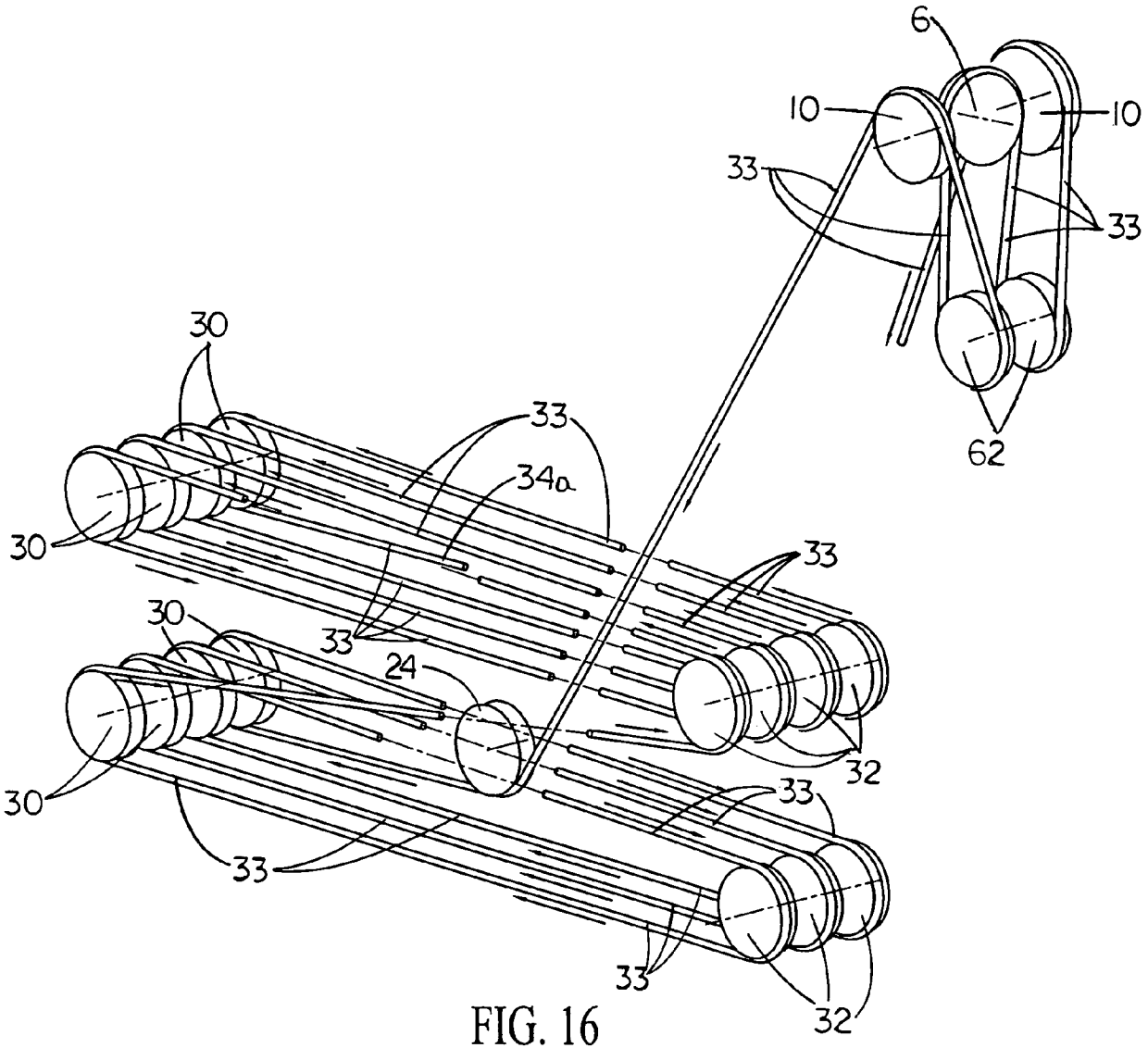
FIG. 16 is a schematic diagram of a typical operating cable and sheave configuration for a typical crown sheave configuration in one bank or set of tram sheaves, stationary mount sheaves and a single fast line sheave.

Referring now to FIGS. 9, 9A-11 and 16 of the drawings, in some illustrative embodiments the telescoping workover rig is generally indicated by reference numeral 1*a*. In the telescoping workover rig 1*a*, the carrier 27 may be characterized by a transporter 25, fitted with wheels 25*a*; an engine 25*b*; a cab 26; a bed 26*a*; and one or more fuel tanks 26*b*, as illustrated. The bed 26*a* of the transporter 25 is sufficiently large to accommodate a single drive cylinder assembly 35, the drive cylinder 38 of which is bolted or otherwise fixed to the bed 26*a* in any convenient fashion. The drive cylinder 38 receives a stationary sheave mount 31 in fixed relationship, in which stationary sheave mount 31 spaced-apart pairs of upper and lower banks of stationary mount sheaves 32 are rotatably mounted. As illustrated in FIG. 16 of the drawings, the upper banks of stationary mount sheaves 32 are typically characterized by four sheaves each, while the bottom banks each typically includes three sheaves 32. At the opposite end of the drive cylinder assembly 35, a drive cylinder rod 39, illustrated in FIG. 9A, is telescopically extendable from a drive cylinder 38. A pair of trams 29, each typically fitted with tram rollers 29*a*, is provided on the extending or distal end of the drive cylinder rod 39. The tram rollers 29*a* are each rotatably mounted on a roller mount 29*b* and typically ride on a rail 27*a* that is bolted or otherwise attached to the bed 26*a* of the transporter 25, as further illustrated in FIG. 9A of the drawings. The trams 29 are each fitted with tram sheaves 30, rotatably attached to the trams 29 by sheave axles 28, and typically arranged in upper and lower banks of four tram sheaves 30 each, as further illustrated in FIG. 16. The respective banks of tram sheaves 30 are arranged in the trams 29 in facing, spaced-apart relationship with respect to the corresponding banks of stationary mount sheaves 32, rotatably provided in the stationary sheave mounts 31, typically attached to the drive cylinder 38. A pair of lifting cylinder assemblies 65 is also provided on the transporter 25. Each lifting cylinder assembly 65 includes a lifting cylinder 66, having a lifting cylinder rod 67 selectively extendable therefrom for pivotal connection to a rod pivot plate 68*a*, mounted on the bottom mast section 15 and receiving a pivot pin 68*b*. As illustrated in FIG. 9A, each lifting cylinder 66 is typically pivotally attached to the bed 26*a* of the transporter 25 at a lifting cylinder pivot 66*a*, using a pivot pin 68*b*.

In some embodiments, the bottom mast section 15 is pivotally attached to a derrick mount 13 at a derrick pivot 14*a*, utilizing a derrick pivot pin 14*b* (FIG. 9A). Similarly, the derrick mount 13 is typically pivotally attached to the bed 26*a* of the transporter 25 at a like derrick mount pivot 14, using a derrick pivot pin 14*b*.

Accordingly, referring again to FIGS. 9 and 9A of the drawings, under circumstances where it is desired to pivot the derrick 2 from the horizontal transportation position (FIG. 9) to the substantially vertical configuration (FIG. 9A), the lifting cylinders 66 are activated in unison, utilizing a hydraulic system (not illustrated) which may be designed in the same manner as that which was heretofore described in the illustrative embodiments of the telescoping workover rig 1 with respect to FIGS. 1-8. Each lifting cylinder rod 67 is thusly extended, either telescopically from the corresponding lifting cylinder 66, as illustrated, or in a single cylinder rod design, according to the knowledge of those skilled in the art, to pivot at the rod pivot 68, on the rod pivot plate 68*a* and pivot pin 68*b* and cause the derrick 2 to pivot upwardly on the derrick pivot pin 14*b*, as illustrated by the alternative positions of the derrick 2 in FIG. 9A. Relocation of the derrick 2 from the substantially vertical configuration illustrated in FIGS. 9 and 9A is achieved by reversing operation of the lifting cylinder assemblies 65 to retract the lifting cylinder rods 67 into the respective lifting cylinders 66 and return the derrick 2 to the horizontal position illustrated in FIG. 9A.

Figure 6:
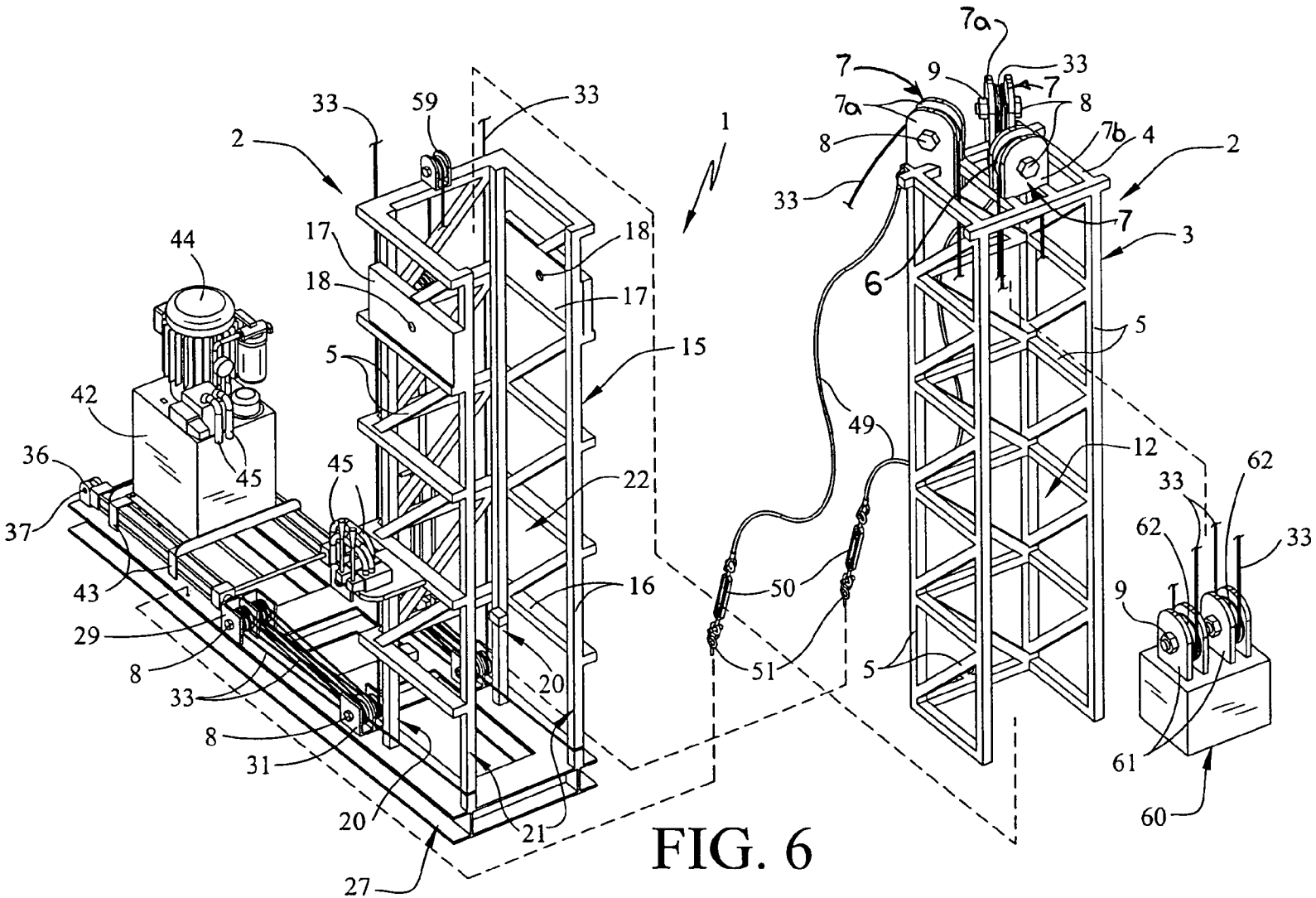
FIG. 6 is an exploded, perspective view of an illustrative embodiment of the telescoping workover rig, more particularly illustrating a traveling block component in raised position relative to the top mast section.
Figure 10:
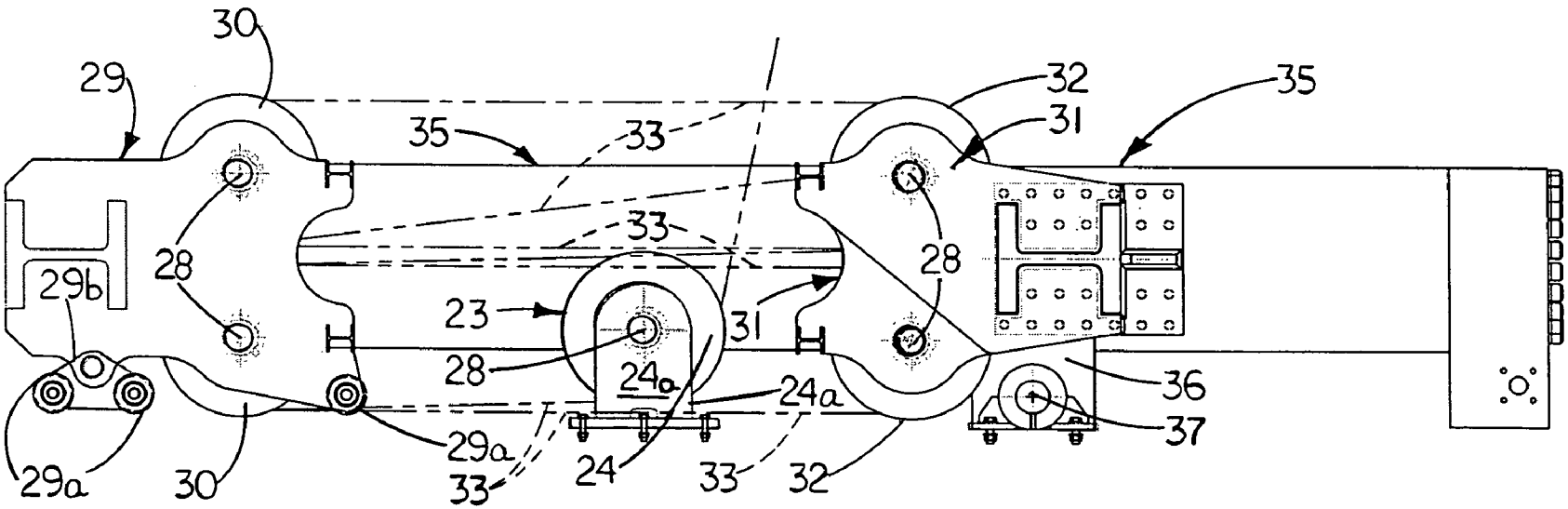
FIG. 10 is an elevational view of an illustrative single drive cylinder embodiment of the telescoping workover rig, more particularly illustrating a working tram and tram sheave configuration, as well as a set of fixed or stationary mount sheaves and fixed sheave mount and a fast line sheave and mount.
Figure 11:
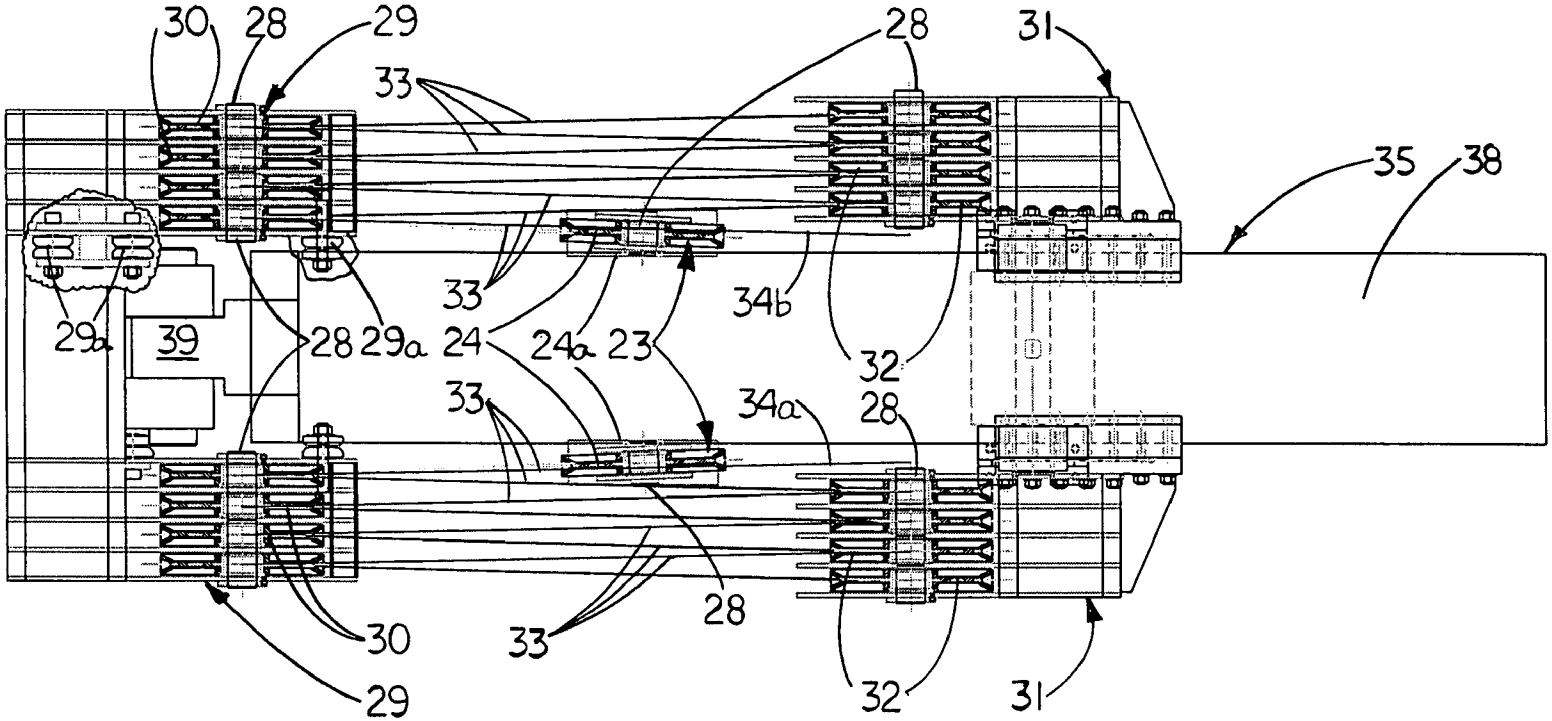
FIG. 11 is a plan view of the illustrative single drive cylinder embodiment of the telescoping workover rig illustrated in FIG. 10, more particularly illustrating respective sets or pairs of tram sheaves on a movable tram, fixed mount sheaves on a fixed sheave mount and a pair of fast line sheaves.

In the telescoping workover rig 1*a*, the arrangement of the forward pair 7*a* and rear pair 7*b* of the crown sheave mounts 7 (FIGS. 1-3) on the water table top 4 of the top mast section 3 may be the same as that which was heretofore described with respect to the telescoping workover rig 1 in FIGS. 1-8. Referring now to FIGS. 10, 11 and 16 of the drawings, in a typical cable and sheave arrangement of the telescoping workover rig 1*a*, a single operating cable 33 is wound on the tram sheaves 30, the stationary mount sheaves 32 and the dead man crown sheave 6 (FIGS. 1-3) and adjacent fast line crown sheaves 10, located at the watertable top 4 of the derrick 2. The operating cable 33 is also wound around the two travelling block sheaves 62, attached to the travelling block 60 and around two fast line sheaves 24, located between the respective sets of stationary mount sheaves 32 and tram sheaves 30, as illustrated in FIGS. 10 and 11. The first cable end 34*a* and second cable end 34*b* (FIGS. 11 and 16) of the operating cable 33 are fixed to either the bed 26*a* (FIG. 9) of the transporter 25 or to an alternative fixed location, to facilitate lengthening and shortening the respective lengths of operating cable 33 located between the respective banks of tram sheaves 30 and stationary mount sheaves 32, as hereinafter further described. One of the stacked banks of tram sheaves 30 and stationary mount sheaves 32 is illustrated in FIG. 16 in schematic, along with the dead man crown sheave 6 and the fast line crown sheaves 10, which are mounted on the watertable top 4 of the derrick 2, and the pair of travelling block sheaves 62 (fixed to the travelling block 60 as illustrated in FIG. 6 of the drawings). Accordingly, FIG. 16 illustrates a single bank of stacked tram sheaves 30 and stationary mount sheaves 32 and a single fast line sheave 24.

As illustrated in FIG. 16, the continuous operating cable 33 typically extends from fixed attachment at the first cable end 34*a*, around the innermost one of the top tram sheaves 30 in the first top set of tram sheaves and from there around the innermost one of the opposed stationary mount sheaves 32 in the first top set of stationary sheaves. From this point the operating cable 33 projects around the opposed second from the innermost one of the top tram sheaves 30 and from there back to an opposed second from the innermost stationary top one of the mount sheaves 32. The operating cable 33 then extends to an opposite third from the inside one of the top tram sheaves 30 and back to the third from the inside one of the top stationary mount sheaves 32. The operating cable 33 then projects to the fourth from the inside one of the top tram sheaves 30 and from that sheave to the fourth from the inside one of the top stationary mount sheaves 32. From this point, the operating cable 33 extends to the outermost one of the bottom set of tram sheaves 30 in the tram sheaves.

The operating cable 33 extends from the outside one of the bottom set of tram sheaves to the opposed outside one of the bottom set of stationary mount sheaves 32. From here, the operating cable 33 projects around the opposite second from the outside one of the bottom tram sheaves 30 and then back to the second from the outside one of the bottom stationary mount sheaves 32. The operating cable 33 then projects to the opposed third from the outside one of the bottom tram sheaves 30 and back to the third from the outside one of the bottom stationary mount sheaves 32. The operating cable 33 is then extended around the fourth from the outside one of the opposed bottom tram sheaves 30 and around the fast line sheave 24 and upwardly, to the outside one of the fast line crown sheaves 10. From this point the operating cable 33 extends downwardly, around the first one of the traveling block sheaves 62 and upwardly around the dead man sheave 6. The operating cable 33 then projects back downwardly, around the second one of the traveling block sheaves 62 and upwardly, around the inside one of the fast line crown sheaves 10. The operating cable 33 then extends downwardly to the fast line sheave 24 in the second bottom and top sets of the second bank of tram sheaves 30 and stationary mount sheaves 32 (not illustrated in FIG. 16). The operating cable 33 is then wrapped around the respective second bank of upper and lower tram sheaves 30 and stationary mount sheaves 32 in the sequence described above with respect to the first bank or assembly of tram sheaves 30 and stationary mount sheaves 32 illustrated in FIG. 16.

The relative movement of the respective segments of the operating cable 33 are indicated by the arrows in FIG. 16 when the respective banks of tram sheaves 30 are caused to move away from the corresponding sets of fixed stationary mount sheaves 32, by operation of the drive cylinder rod 39 (FIG. 11) which extends into and retracts from the drive cylinder 38, respectively. Accordingly, in the single bank of tram sheaves 30 and stationary mount sheaves 32 illustrated in FIG. 16, since the first cable end 34*a* and the opposite-cable end (not illustrated) are fixed, extension of the drive cylinder rod 39 from the drive cylinder 38 to extend the tram sheaves 30 outwardly away from the stationary mount sheaves 32, locates the cable segments of the operating cable 33 in the relative illustrated positions. The segments of the operating cable 33 thus move in the direction of the arrows in FIG. 16 to lengthen the operating cable 33 and thereby raise the travelling block sheaves 62 and thus, the travelling block 60 (illustrated in FIG. 6) to pull pipe from a well (not illustrated) as was heretofore described with regard to the first embodiments of the telescoping workover rig 1. In reverse fashion, under circumstances in which the travelling block 60 is to be lowered in the derrick 2, the drive cylinder 38 is operated to retract the drive cylinder rod 39 therein, move the tram sheaves 30 and the respective segments of the operating cable 33 in the reverse direction from the arrows illustrated in FIG. 16 and thus shorten the segments of the operating cable 33. Raising and lowering of the travelling block 60 is thus effected by operating the drive cylinder 38 to extend and retract the drive cylinder rod 39 as was described above, using a hydraulic control system (not illustrated) which may be of the type described heretofore with respect to the first embodiments of the telescoping workover rig 1 or according to the knowledge of those skilled in the art. It will be further appreciated from a consideration of FIG. 16 that the single, unconnected segment of the operating cable 33 which extends downwardly from one of the fast line crown sheaves 10 may extend to a second fast line sheave 24 (not illustrated) provided in the second or adjacent bank of tram sheaves 30 and stationary mount sheaves 32 (not illustrated) to cause these banks of sheaves to operate in orchestration with the tram sheaves 30 and stationary mount sheaves 32 illustrated in FIG. 16, responsive to extension and retraction of the drive cylinder rod 39 in the drive cylinder 38. The respective banks of tram sheaves 30 and stationary mount sheaves 32 are illustrated in FIGS. 10 and 11, along with the respective fast line sheave assemblies 23, which include the sheave brackets 24*a*, the corresponding fast line sheaves 24 rotatably mounted therein and the sheave axles 28 on which the fast line sheaves 24 are mounted.

Referring now to FIGS. 9, 9A and 12-15 of the drawings, in typical operation of the telescoping workover rig 1*a*, the top mast section 3 is telescopically fitted in the bottom mast section 15 of the derrick 2, as was heretofore described with respect to FIGS. 1-8 of the drawings. Furthermore, the top mast section 3 is typically extended from within the bottom mast section 15 using the scoping cylinder assembly 52, which includes a scoping cylinder 53 and an extendable scoping cylinder rod 54 (FIG. 3), along with scoping sheaves (not illustrated), as was further heretofore described with respect to FIGS. 1-8 of the drawings. Accordingly, after the derrick 2 is pivoted to an upwardly-extending functional configuration from the transporter 25 using the twin lifting cylinder assemblies 65, typically in the manner which was described heretofore with respect to FIGS. 9 and 9A of the drawings, the scoping cylinder 53 (FIGS. 1 and 3) is activated to extend the top mast section 3 from within the bottom mast section 15 of the derrick 2.

Figure 13:
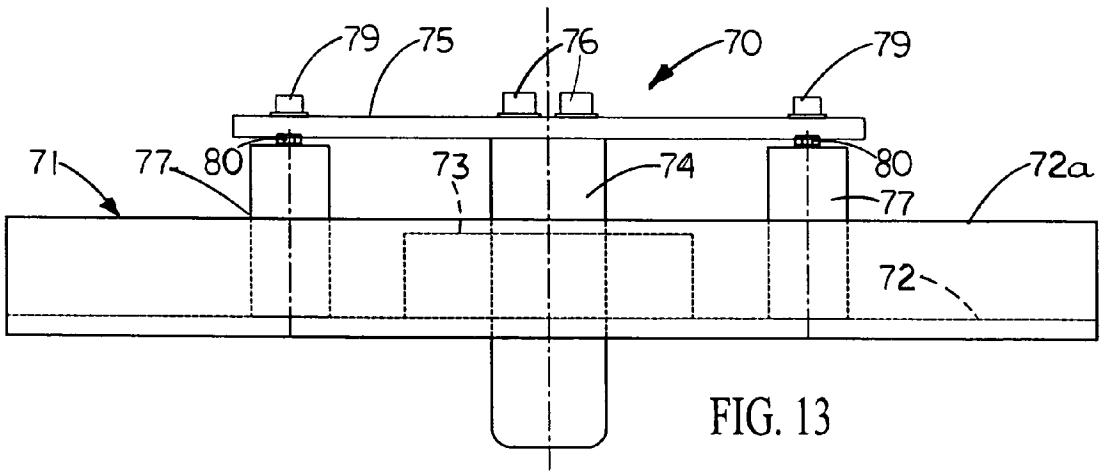
FIG. 13 is a plan view of the top mast support assembly illustrated in FIG. 12 in mast-engaging configuration for releasing the top mast in elevated configuration in the bottom mast.
Figure 14:
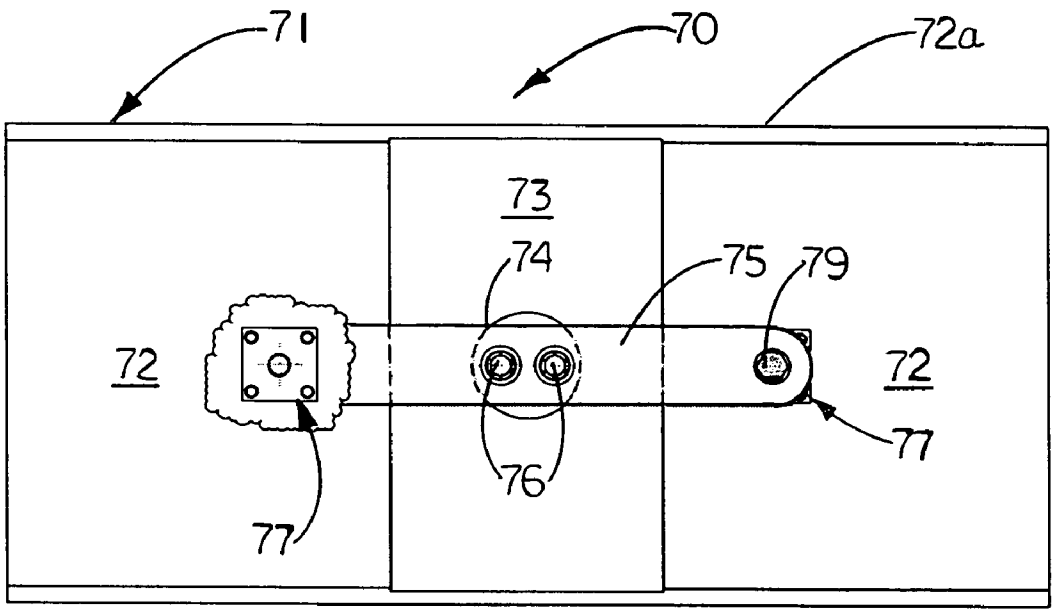
FIG. 14 is a plan view of the top mast support assembly illustrated in FIGS. 12 and 13 for supporting the top mast in elevated configuration in the bottom mast.
Figure 15:
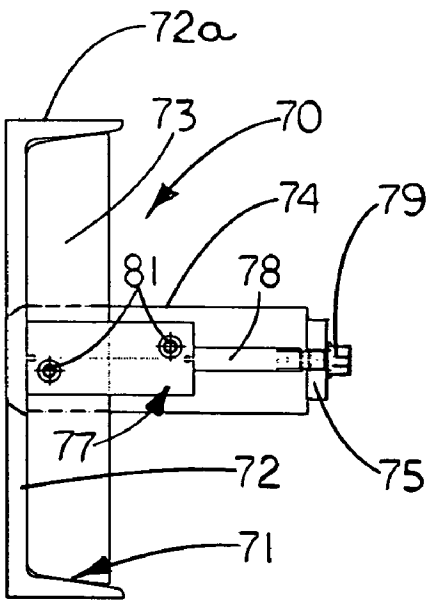
FIG. 15 is an end view of the top mast support assembly illustrated in FIGS. 12-14 in mast-release configuration for releasing the top mast in elevated configuration in the bottom mast.

In some embodiments, the top mast section 3 is stabilized inside the bottom mast section 15 at full extension of the top mast section 3 in the bottom mast section 15, using a pair of top mast support assemblies 70, illustrated in FIG. 9A of the drawings. As in the first embodiment described above, each top mast support assembly 70 is typically characterized by a support channel 71 having a support channel web 72 and a support channel flange 72*a*, as further illustrated in FIGS. 12-15 of the drawings. Each support channel 71 is typically welded to the front mast legs 20 and the rear mast legs 21 of the bottom mast section 15, respectively, such that the pair of support channels 71 are disposed in facing relationship on both sides of the bottom mast section 15 of the derrick 2. A support pin housing 73 is typically welded to each support channel 71, as further illustrated in FIGS. 12-15 and a support pin 74 is slidably disposed in the support pin housing 73 and has one end connected to a support pin plate 75, typically using support pin bolts 76. A pair of hydraulic pin cylinders 77 are also mounted in each of the support channels 71 and have a pin cylinder piston extending outwardly to each end of the support pin plates 75, respectively, where the pin cylinder pistons are connected to the support pin plate 75, typically using pin cylinder piston bolts 79 and corresponding pin cylinder piston rod nuts 80, as further illustrated in FIGS. 12-15 of the drawings. Accordingly, it will be appreciated from a consideration of FIGS. 12-15 of the drawings that simultaneous operation of the pairs of pin cylinders 77 in each of the assemblies causes selective extension and retraction of the respective pin cylinder pistons 78 in the corresponding pin cylinders 77 and thus extension and retraction of the support pins 74 in each of the top mast support assemblies 70, to and from the support channel 71. As illustrated in FIG. 13 of the drawings, under circumstances where the respective pin cylinder pistons 78 are retracted inside the pin cylinders 77, the support pins 74 are simultaneously extended from the support channel webs 72 of the support channels 71 and into corresponding mount plate openings 18 provided in the mount plate 17 structure of the top mast section 3, to securely seat the top mast section 3 or on the bottom mast section 15. Under circumstances where it is desired to lower the top mast section 3 in the bottom mast section 15 of the derrick 2, the pairs of pin cylinders 77 are each activated to extend the respective pin cylinder pistons 78 therefrom and retract the support pins 74 in each of the support channels 71 to the position illustrated in FIG. 12. This allows the scoping cylinder 53 to operate and lower the top mast section 3 inside the bottom mast section 15, as heretofore described with respect to FIGS. 1-8 of the drawings.

While the preferred embodiments of this invention have been described above, it will be recognized and understood that modifications may be made in the invention and the appended claims are intended to cover all such modifications which may fall within the spirit and scope of the invention.

Having described my invention with the particularity set forth above, what is claimed is:

1. A workover rig comprising a derrick mounted on a support adjacent to a well; a first set of sheaves movably provided on said support; a second set of sheaves fixed with respect to said support and facing said first set of sheaves; a drive mechanism provided on said support, said drive mechanism connected to said first set of sheaves for moving said first set of sheaves with respect to said second set of sheaves; an assembly of crown sheaves provided on said derrick; an operating cable having both ends fixed, said operating cable extending around said first set of sheaves, said second set of sheaves and said assembly of crown sheaves; a traveling block positioned beneath said assembly of crown sheaves above the well; and traveling block sheaves rotatably provided on said traveling block for receiving said operating cable, wherein adjustment of said first set of sheaves with respect to said second set of sheaves responsive to operation of said drive mechanism selectively lengthens and shortens said operating cable between said first set of sheaves and said second set of sheaves and causes said traveling block to rise and fall above the well.

2. The workover rig of claim 1 wherein said drive mechanism comprises at least one fluid-operated drive cylinder mounted on said support and a drive cylinder rod extending from said drive cylinder and wherein said drive cylinder rod is attached to said first set of sheaves and said adjustment of said first set of sheaves with respect to said second set of sheaves is caused by extension and retraction of said drive cylinder rod in said drive cylinder.

3. The workover rig of claim 1 wherein said assembly of crown sheaves comprises a pair of fast line crown sheaves and a dead man crown sheave provided on said derrick and wherein said operating cable extends upwardly from a first one of said second set of sheaves to a first one of said pair of fast line crown sheaves and downwardly from said first one of said pair of fast line crown sheaves to a first one of said traveling block sheaves and upwardly to said dead man crown sheave and downwardly to a second one of said traveling block sheaves, and upwardly to a second one of said pair of fast line crown sheaves and then downwardly to a second one of said second set of sheaves.

4. The workover rig of claim 3 wherein said drive mechanism comprises at least one fluid-operated drive cylinder mounted on said support and a drive cylinder rod extending from said drive cylinder, and wherein said drive cylinder rod is attached to said first set of sheaves and said adjustment of said first set of sheaves with respect to said second set of sheaves is caused by extension and retraction of said drive cylinder rod in said drive cylinder.

5. The workover rig of claim 1 comprising at least one load line extending from said derrick to said support for stabilizing said derrick on said support.

6. The workover rig of claim 5 wherein said at least one load line comprises two load lines extending from said derrick to said support in spaced-apart relationship with respect to each other.

7. The workover rig of claim 6 comprising turnbuckles provided in said load lines for adjusting tension in said load lines.

8. The workover rig of claim 7 wherein said drive mechanism comprises at least one fluid-operated drive cylinder mounted on said support and a drive cylinder rod extending from said drive cylinder and wherein said drive cylinder rod is attached to said first set of sheaves and said adjustment of said first set of sheaves with respect to said second set of sheaves is caused by extension and retraction of said drive cylinder rod in said drive cylinder.

9. The workover rig of claim 8 wherein said assembly of crown sheaves comprises a pair of fast line crown sheaves and a dead man crown sheave provided on said derrick, and wherein said operating cable extends upwardly from a first one of said second set of sheaves to a first one of said pair of fast line crown sheaves and downwardly from said first one of said pair of fast line crown sheaves to a first one of said traveling block sheaves and upwardly to said dead man crown sheave, and downwardly to a second one of said traveling block sheaves, and upwardly to a second one of said pair of fast line crown sheaves and then downwardly to a second one of said second set of sheaves.

10. The workover rig of claim 1 wherein said derrick comprises a bottom mast section and a top mast section for telescoping in said bottom mast section and comprising a scoping cylinder provided on said bottom mast section, a scoping cylinder rod extendable from said scoping cylinder and a scoping cylinder cable connected to said scoping cylinder rod, said scoping cylinder cable also attached to said top mast section for raising and lowering said top mast section in said bottom mast section responsive to operation of said scoping cylinder.

11. The workover rig of claim 10 wherein said drive mechanism comprises at least one fluid-operated drive cylinder mounted on said support and a drive cylinder rod extending from said drive cylinder and wherein said drive cylinder rod is attached to said first set of sheaves, respectively, and said adjustment of said first set of sheaves with respect to said second set of sheaves is caused by extension and retraction of said drive cylinder rod in said drive cylinder.

12. The workover rig of claim 10 wherein said assembly of crown sheaves comprises a pair of fast line crown sheaves and a dead man crown sheave mounted on said top mast section and wherein said operating cable extends upwardly from a first one of said second set of sheaves to a first one of said pair of fast line crown sheaves and downwardly from said first one of said pair of fast line crown sheaves to a first one of said traveling block sheaves and upwardly to said dead man crown sheave and downwardly to a second one of said traveling block sheaves, and upwardly to a second one of said pair of fast line crown sheaves and then downwardly to a second one of said second set of sheaves.

13. The workover rig of claim 10 comprising a pair of fast line sheaves positioned between said first set of sheaves and said second set of sheaves for receiving said operating cable and wherein said assembly of crown sheaves comprises a pair of fast line crown sheaves and a dead man crown sheave mounted on said top mast section and said operating cable extends from said first set of sheaves and said second set of sheaves to a first one of said pair of fast line sheaves and upwardly from said first one of said pair of fast line sheaves to a first one of said pair of fast line crown sheaves and downwardly to a first one of said traveling block sheaves and upwardly to said dead man crown sheave and downwardly to a second one of said traveling block sheaves, and upwardly to a second one of said pair of fast line crown sheaves and then downwardly to a second one of said pair of fast line sheaves, said first set of sheaves and said second set of sheaves and said drive mechanism comprises at least one fluid-operated drive cylinder mounted on said support and a drive cylinder rod extending from said drive cylinder and wherein said drive cylinder rod is attached to said first set of sheaves, respectively, and said adjustment of said first set of sheaves with respect to said second set of sheaves is caused by extension and retraction of said drive cylinder rod in said drive cylinder.

14. The workover rig of claim 13 comprising at least one load line extending from said top mast section to said carrier for stabilizing said top mast section and said bottom mast section on said carrier.

15. The workover rig of claim 14 wherein said at least one load line comprises two load lines extending from said top mast section to said carrier in spaced-apart relationship with respect to each other.

16. The workover rig of claim 15 comprising turnbuckles provided in said load lines for adjusting tension in said load lines.

17. The workover rig of claim 10 comprising at least one top mast support assembly carried by said bottom mast section for removably engaging said top mast section responsive to raising of said top mast section in said bottom mast section by operation of said scoping cylinder.

18. The workover rig of claim 17 wherein said drive mechanism comprises a fluid-operated drive cylinder mounted on said support and a drive cylinder rod extending from said drive cylinder and wherein said drive cylinder rod is attached to said first set of sheaves, respectively, and said adjustment of said first set of sheaves with respect to said second set of sheaves is caused by extension and retraction of said drive cylinder rod in said drive cylinder.

19. The workover rig of claim 18 comprising a pair of fast line sheaves positioned between said first set of sheaves and said second set of sheaves for receiving said operating cable and wherein said assembly of crown sheaves comprises a pair of fast line crown sheaves and a dead man crown sheave mounted on said top mast section and wherein said operating cable extends from said first set of sheaves and said second set of sheaves to a first one of said pair of fast line sheaves and upwardly from said first one of said pair of fast line sheaves to a first one of said pair of fast line crown sheaves and downwardly from said first one of said pair of fast line crown sheaves to a first one of said traveling block sheaves and upwardly to said dead man crown sheave and downwardly to a second one of said traveling block sheaves, and upwardly to a second one of said pair of fast line crown sheaves and then downwardly to a second one of said pair of fast line sheaves and to said first set of sheaves and said second set of sheaves and wherein said drive mechanism comprises at least one fluid-operated drive cylinder mounted on said support and a drive cylinder rod extending from said drive cylinder and wherein said drive cylinder rod is attached to said first set of sheaves, respectively, and said adjustment of said first set of sheaves with respect to said second set of sheaves is caused by extension and retraction of said drive cylinder rod in said drive cylinder.

20. The workover rig of claim 19 comprising at least one load line extending from said top mast section to said support for stabilizing said top mast section and said bottom mast section on said carrier.

21. A workover rig comprising a derrick mounted on a carrier for positioning adjacent to a well; a pair of stationary sheave mounts fixed with respect to the carrier; a pair of trams movable on the carrier and facing said pair of stationary sheave mounts, respectively; at least one stationary mount sheave rotatably provided on each of said pair of stationary sheave mounts and at least one tram sheave rotatably provided on each of said pair of trams; at least one fluid-operated drive cylinder provided on said carrier and a drive cylinder rod extending from said drive cylinder and attached to said pair of trams; an assembly of crown sheaves provided on said derrick; an operating cable having both ends spaced-apart and fixed, said operating cable extending around said at least one tram sheave, said at least one stationary mount sheave and said assembly of crown sheaves; a travelling block positioned beneath said assembly of crown sheaves in said derrick; and traveling block sheaves provided on said traveling block for engaging said operating cable, wherein said traveling block is caused to selectively rise and fall at said derrick over the well responsive to operation of said drive cylinder and changing a length of said operating cable between said pair of trams and said pair of stationary sheave mounts when said derrick is in a substantially upright configuration on the carrier.

22. The workover rig of claim 21 wherein said derrick comprises a top mast section and a bottom mast section and comprising a scoping cylinder provided on said bottom mast section and a scoping cylinder cable connected to said scoping cylinder, said scoping cylinder cable attached to said top mast section for raising and lowering said top mast section with respect to said bottom mast section responsive to operation of said scoping cylinder.

23. The workover rig of claim 22 wherein said assembly of crown sheaves comprises a pair of fast line crown sheaves and a dead man crown sheave mounted on said top mast section and wherein said operating cable extends upwardly from said stationary mount sheave in a first one of said stationary sheave mounts to a first one of said pair of fast line crown sheaves and downwardly from said first one of said pair of fast line crown sheaves to a first one of said traveling block sheaves and upwardly to said dead man crown sheave and downwardly to a second one of said traveling block sheaves, and upwardly to a second one of said pair of fast line crown sheaves and then downwardly to said stationary sheave mount in a second one of said stationary sheave mounts.

24. The workover rig of claim 23 wherein said bottom mast section of said derrick is pivotally attached to said carrier and comprising at least one fluid-operated lifting cylinder provided on said carrier and a lifting cylinder rod extending from said lifting cylinder and wherein said lifting cylinder rod is attached to said bottom mast section of said derrick, wherein pivoting of said derrick with respect to the carrier is caused by extension and retraction of said lifting cylinder rod in said lifting cylinder.

25. The workover rig of claim 24 comprising at least one load line extending from said top mast section to the carrier for stabilizing said top mast section and said bottom mast section on the carrier.

26. The workover rig of claim 21 comprising a pair of fast line sheaves rotatably mounted on the carrier between said at least one stationary mount sheave and said at least one tram sheave, respectively, and wherein said assembly of crown sheaves comprises a pair of spaced-apart fast line crown sheaves and a dead man crown sheave spaced-apart from said pair of spaced-apart fast line crown sheaves and said operating cable extends from said at least one tram sheave and said at least one stationary mount sheave to said first one of said pair of fast line sheaves and upwardly from a first one of said pair of fast line sheaves to a first one of said pair of spaced-apart fast line crown sheaves and downwardly from said first one of said pair of spaced-apart fast line crown sheaves to a first one of said travelling block sheaves and upwardly to said dead man crown sheave and downwardly to a second one of said travelling block sheaves and upwardly to a second one of said pair of spaced-apart fast line crown sheaves and then downwardly to a second one of said pair of fast line sheaves and from said second one of said pair of fast line sheaves to said at least one tram sheave and said at least one stationary mount sheave.

27. The workover rig of claim 26 comprising at least one load line extending from said top mast section to the carrier for stabilizing said top mast section and said bottom mast section on the carrier.

28. A workover rig comprising a telescoping derrick pivotally mounted on a carrier for positioning near a well; at least one lifting cylinder mounted on said carrier and a lifting cylinder rod extending from said at least one lifting cylinder and pivotally attached to said derrick, wherein pivotal adjustment of said derrick with respect to said carrier is caused by extension and retraction of said lifting cylinder rod in said at least one lifting cylinder; a pair of stationary sheave mounts fixed with respect to said carrier; a pair of movable trams provided on said carrier and facing said pair of stationary sheave mounts, respectively; a plurality of stationary mount sheaves rotatably provided on each of said pair of stationary sheave mounts and a plurality of tram sheaves rotatably provided on each of said pair of trams; a fluid-operated drive cylinder provided on the carrier and a drive cylinder rod extending from said drive cylinder for attachment to said pair of trams; an assembly of crown sheaves provided on said derrick above said carrier; an operating cable having both ends fixed and said operating cable extending around said plurality of tram sheaves, said plurality of stationary mount sheaves and said assembly of crown sheaves; a traveling block suspended at least partially in said derrick beneath said assembly of crown sheaves over the well; and traveling block sheaves provided on said traveling block for engaging said operating cable, wherein said traveling block is caused to selectively rise and fall in said derrick responsive to operation of said drive cylinder and changing a length of said operating cable between said plurality of tram sheaves and said plurality of stationary mount sheaves.

29. The workover rig of claim 28 comprising a pair of fast line sheaves rotatably mounted on the carrier between said plurality of stationary mount sheaves and said plurality of tram sheaves, respectively, and wherein said assembly of crown sheaves comprises a pair of spaced-apart fast line crown sheaves and a dead man crown sheave spaced-apart from said pair of spaced-apart fast line crown sheaves and said operating cable extends from a first set of said plurality of tram sheaves and said plurality of stationary mount sheaves to a first one of said pair of fast line sheaves and then upwardly from said first one of said pair of fast line sheaves to a first one of said pair of spaced-apart fast line crown sheaves and downwardly from said first one of said pair of spaced-apart fast line crown sheaves to a first one of said travelling block sheaves and upwardly to said dead man crown sheave and downwardly to a second one of said travelling block sheaves and upwardly to a second one of said spaced-apart fast line crown sheaves and then downwardly to a second one of said pair of fast line sheaves and from said second one of said pair of fast line sheaves to a second set of said plurality of tram sheaves and said plurality of stationary mount sheaves.

30. The workover rig of claim 29 comprising at least one load line extending from said derrick to the carrier for stabilizing said derrick on said carrier.

31. The workover rig of claim 28 wherein said at least one lifting cylinder comprises a pair of spaced-apart fluid-operated lifting cylinders mounted on the carrier for pivoting said derrick with respect to the carrier by extension and retraction of said lifting cylinder rods in said fluid-operated lifting cylinders, respectively.

32. The workover rig of claim 31 comprising at least one load line extending from said derrick to the carrier for stabilizing said derrick on the carrier.

33. The workover rig of claim 28 wherein said telescoping derrick comprises a top mast section and a bottom mast section and comprising a scoping cylinder provided on said bottom mast section, a scoping cylinder rod extendable from said scoping cylinder and a scoping cylinder cable connected to said scoping cylinder rod, said scoping cylinder cable attached to said top mast section for raising and lowering said top mast section with respect to said bottom mast section responsive to operation of said scoping cylinder.

34. The workover rig of claim 33 comprising at least one top mast support assembly carried by said bottom mast section for removably engaging said top mast section responsive to raising of said top mast section in said bottom mast section by operation of said scoping cylinder.

35. The workover rig of claim 31 wherein said telescoping derrick comprises a top mast section and a bottom mast section and comprising:

(a) a scoping cylinder provided on said bottom mast section, a scoping cylinder rod extendable from said scoping cylinder and a scoping cylinder cable connected to said scoping cylinder rod, said scoping cylinder cable attached to said top mast section for raising and lowering said top mast section with respect to said bottom mast section responsive to operation of said scoping cylinder;

(b) at least one load line extending from said top mast section to the carrier for stabilizing said top mast section and said bottom mast section on the carrier; and (c) at least one top mast support assembly carried by said bottom mast section for removably engaging said top mast section responsive to raising of said top mast section in said bottom mast section by operation of said scoping cylinder.

* * * * *